US007564179B2

(12) United States Patent
Yotani et al.

(10) Patent No.: US 7,564,179 B2
(45) Date of Patent: Jul. 21, 2009

(54) FLAT PANEL DISPLAY, GATE ELECTRODE STRUCTURE, AND GATE ELECTRODE STRUCTURE MANUFACTURING METHOD

(75) Inventors: Junko Yotani, Mie (JP); Sashiro Uemura, Mie (JP)

(73) Assignee: Noritake Co., Ltd., Aichi (JP)

( * ) Notice: Subject to any disclaimer, the term of this patent is extended or adjusted under 35 U.S.C. 154(b) by 491 days.

(21) Appl. No.: 11/325,890

(22) Filed: Jan. 4, 2006

(65) Prior Publication Data

US 2006/0145594 A1 Jul. 6, 2006

(30) Foreign Application Priority Data

Jan. 5, 2005 (JP) ..... 2005-000655

(51) Int. Cl.
*H01J 1/62* (2006.01)

(52) U.S. Cl. ..... 313/495; 313/292

(58) Field of Classification Search ..... 313/495–497, 313/309, 336, 351

See application file for complete search history.

(56) References Cited

U.S. PATENT DOCUMENTS 6,259,199 B1 * 7/2001 Moradi et al. ..... 313/495
6,380,671 B1 4/2002 Lee
6,943,493 B2 9/2005 Uemura et al.

FOREIGN PATENT DOCUMENTS

| | | | |
|---|---|---|---|
| JP | 1-296535 | | 11/1989 |
| JP | 2-299124 | | 12/1990 |
| JP | 6-44897 | | 2/1994 |
| JP | 817365 | | 1/1996 |
| JP | 9-306395 | | 11/1997 |
| JP | 2002-343281 | A | 11/2002 |
| JP | 2003308797 | * | 10/2003 |
| JP | 2004-193038 | A | 7/2004 |
| JP | 2004-207222 | | 7/2004 |
| JP | 2004-335440 | | 11/2004 |

* cited by examiner

*Primary Examiner*—Vip Patel
(74) *Attorney, Agent, or Firm*—Blakely, Sokoloff, Taylor & Zafman LLP

(57) ABSTRACT

A flat panel display includes a substrate, a front glass, a cathode, a gate electrode, a plurality of front ribs, a phosphor film and a metal-backed film, and a gate rib. The front glass is arranged to oppose the substrate and forms a vacuum envelope together with the substrate. The front glass is transparent at least partially. The cathode is arranged on the substrate. The gate electrode is arranged between the substrate and front glass and includes an electron-passing hole through which an electron emitted from the cathode passes. The front ribs extend vertically at a predetermined interval from the front glass toward the gate electrode. The phosphor film and metal-backed film are stacked on a region of the front glass which is sandwiched by the front ribs. The gate rib extends vertically from the gate electrode toward the front glass and is in contact with the front ribs. A gate electrode structure and a gate electrode structure manufacturing method are also disclosed.

12 Claims, 9 Drawing Sheets

FLAT PANEL DISPLAY, GATE ELECTRODE STRUCTURE, AND GATE ELECTRODE STRUCTURE MANUFACTURING METHOD

BACKGROUND OF THE INVENTION

The present invention relates to a gate electrode structure which controls electron emission from a field emission type electron source, a method of manufacturing the same, and a flat panel display which has the gate electrode structure.

In recent years, as a flat panel display such as an FED (Field Emission Display) or a flat vacuum fluorescent display in which electrons emitted from an electron-emitting source serving as a cathode bombard a light-emitting portion formed of phosphors on a counterelectrode to emit light, various types that use nanotube fibers, e.g., carbon nanotubes or carbon nanofibers, as the electron-emitting source have been proposed (for example, see Japanese Patent Laid-Open Nos. 2002-343281 and 2004-193038). FIG. 15 shows an example of a conventional flat panel display which uses nanotube fibers as an electron-emitting source.

This flat panel display has a cathode substrate 120 having a substrate 121 made of glass or the like, an anode substrate 130 having a front glass 131, and a gate substrate 110 which is disposed substantially parallel to the substrate 121 and front glass 131. The substrate 121 of the cathode substrate 120 and the front glass 131 of the anode substrate 130 form an envelope. The interior of the envelope is held in a vacuum state.

The cathode substrate 120 further has a plurality of substrate ribs 122 which are formed parallel to each other on the substrate 121, and cathodes 123 which are formed in regions sandwiched by the substrate ribs 122 on the substrate 121 and substantially form matrices when seen from the top. As the cathodes 123, electron-emitting sources made of the nanotube fibers described above are used.

The anode substrate 130 further has a plurality of black matrices 132 which are formed on the front glass 131 to be parallel to the substrate ribs 122, phosphor films 133R, 133G, and 133B which are formed on regions sandwiched by the black matrices 132 on the front glass 131, metal-backed films 134 which are formed on the phosphor films 133R, 133G, and 133B to serve as anodes, and a plurality of front ribs 135 which are formed on the black matrices 132. The black matrices 132 serve to prevent leaking light emitted from adjacent phosphors so as to improve the contrast of the flat panel display. The black matrices 132 are desirably formed as thin as possible to prevent a decrease in luminance of the flat panel display. The front ribs 135 are also desirably formed thin.

The gate substrate 110 comprises a glass plate 111, a flat electrode 112 which is formed on the surface of the glass plate 111 on the anode substrate 130 side, band-like gate electrodes 113 formed on the surface of the glass plate 111 on the cathode substrate 120 side to correspond to the phosphor films 133R, 133G, and 133B, and an insulating layer 114 which is formed on the gate electrodes 113. The gate substrate 110 has electron-passing holes 115, substantially circular when seen from the top, which are formed at regions where the band-like gate electrodes 113 and matrix-like cathodes 123 overlap, and extend through the flat electrode 112, glass plate 111, gate electrodes 113, and insulating layer 114. The gate substrate 110 is sandwiched by the substrate ribs 122 of the cathode substrate 120 and the front ribs 135 of the anode substrate 130.

The flat electrode 112 in contact with the front ribs 135 protects the cathodes 123 and gate electrodes 113 from the influence of an electric field generated by the anodes. This can prevent an electric field from being generated by a potential difference between the gate electrodes 113 and the metal-backed films 134 which serve as the anodes, and prevent abnormal discharge between the cathodes 123 and metal-backed films 134, thus preventing leaking light.

In this flat panel display, when a predetermined potential difference is applied between the gate substrate 110 and cathodes 123 such that the gate substrate 110 side has a positive potential, electrons extracted from those regions of the cathodes 123 which intersect the gate electrodes 113 are emitted from the electron-passing holes 115.

More specifically, first, a voltage is applied to the flat electrode 112 to set it to have a higher potential than that of the cathodes 123, so as to form an electric field on the surfaces of the cathodes 123 in advance. When a voltage is further applied to the gate electrodes 113 to set it to have a higher potential than that of the cathodes 123, an electric field is formed on the cathodes 123 to extend from the outer surfaces of the gate electrodes 113 which form the electron-passing holes 115, to extract electrons from the electron-emitting sources on the surfaces of the cathodes 123. The electrons are accelerated by the flat electrode 112 to which the voltage has been applied to set it to have a positive potential with respect to the gate electrodes 113, and emitted from the electron-passing holes 115 toward the front glass 131.

If a positive potential (accelerating voltage) higher than that on the flat electrode 112 is applied to the metal-backed films 134, the electrons emitted from the electron-passing holes 115 are accelerated toward the metal-backed films 134, and penetrate through the metal-backed films 134 to bombard the phosphor films 133R, 133G, and 133B. Thus, the phosphor films 133G, 133B, and 133R emit light.

A method of forming the respective constituent elements of the flat panel display shown in FIG. 15 will be described.

The cathode substrate 120 is formed in the following manner. First, an insulating paste such as a vitreous paste is printed on the substrate 121 with a known printing method such as screen printing to form the substrate ribs 122 on one surface of the substrate 121. Subsequently, the cathodes 123 disposed with electron-emitting sources on their surfaces are disposed on those regions of the substrate 121 which are sandwiched by the substrate ribs 122. This forms the cathode substrate 120. The cathodes 123 described above can be formed by disposing the electron-emitting sources on their surfaces by CVD or the like.

The anode substrate 130 is formed in the following manner. First, the front glass 131 is prepared. An insulating paste such as a vitreous paste is printed on the front glass 131 with a known printing method such as screen printing to form the black matrices 132 on one surface of the front glass 131. Subsequently, a phosphor material is printed on those regions on the front glass 131 which are sandwiched by the black matrices 132 with a known printing method such as screen printing to form the phosphor films 133R, 133G, and 133B. The metal-backed films 134 are formed on the phosphor films 133R, 133G, and 133B with a known deposition method. Finally, a glass paste is repeatedly printed on the black matrices 132 with a known printing method such as screen printing to form the front ribs 135. Alternatively, the front ribs 135 may be formed by fixing members, e.g., strip-like glass plates, made of glass or a ceramic material into predetermined shapes, on the black matrices 132 by adhesion using a frit paste, or by contact bonding using a metal film.

The gate substrate 110 is formed in the following manner. First, the glass plate 111 is prepared, and the flat electrode 112 is formed on its one surface by printing or sputtering. Subsequently, the band-like gate electrodes 113 are formed on the other surface of the glass plate 111 by printing or sputtering. The insulating layer 114 is formed on the other surface of the glass plate 111 by printing or the like to cover the gate electrodes 113. Finally, the electron-passing holes 115 which extend through the flat electrode 112, glass plate 111, gate electrodes 113, and insulating layer 114 are formed by sandblasting.

In the flat panel display, a high luminance can be realized by increasing the amount of current (anode current) flowing through the anodes or the voltage (anode voltage) to be applied to the anodes. If the anode current is increased, the phosphors will decompose. Hence, to realize a high luminance, it is effective to increase the anode voltage. When the anode voltage is increased, the gate electrodes 113 and cathodes 123 cannot be electrically shielded completely due to the influence of the electric field generated in the anodes by the flat electrode 112, and abnormal discharge may occur between the anodes and the cathodes 123. To prevent this, the front ribs 135 must be formed such that the distance between the anodes and the flat electrode 112 is sufficiently large. For example, when the anode voltage is 10 kV, the distance between the anodes and the gate electrodes 113 is desirably about 3.0 mm.

As described above, the front ribs 135 form rods or plates which are very thin as compared to their lengths to prevent a decrease in luminance of the flat panel display. It is therefore difficult to form the front ribs 135 to predetermined heights with the conventional method of repeating printing. For example, when the front ribs 135 are to be formed with widths of about 200 μm, their heights are about 2.0 mm at most. When the front ribs 135 are to be formed with widths of about 50 μm, their heights are about 1.0 mm at most.

When the strip-like glass plates are to be fixed on the black matrices 132 by adhesion or contact bonding to form the front ribs 135, thin glass plates as thin as about 50 μm cannot be formed, and a high-resolution flat panel display cannot be obtained. Assume that comparatively thick glass plates are to be fixed by adhesion. Frit glass or a silver paste is used to fix the glass plates. Thus, even if the glass plates are arrayed on the black matrices 132 highly accurately, they are adversely affected by the thermal expansion of the front glass 131 or the like during annealing. Therefore, it is difficult to array the formed front ribs 135 highly accurately.

SUMMARY OF THE INVENTION

The present invention has been made to solve the problems as described above, and has as its object to provide flat panel display that can realize a high luminance, a gate electrode structure, and a gate electrode structure manufacturing method.

In order to achieve the above object, according to the present invention, there is provided a flat panel display comprising a substrate, a front glass which is arranged to oppose the substrate and forms a vacuum envelope together with the substrate, the front glass being transparent at least partially, a cathode which is arranged on the substrate, a gate electrode which is arranged between the substrate and front glass, the gate electrode comprising an electron-passing hole through which an electron emitted from the cathode passes, a plurality of front ribs which extend vertically from the front glass toward the gate electrode, the plurality of front ribs extending vertically at a predetermined interval, a phosphor film and an anode which are stacked on a region of the front glass which is sandwiched by the front ribs, and a support member which extends vertically from the gate electrode toward the front glass and is in contact with the front ribs.

According to the present invention, there is also provided a gate electrode structure comprising a gate electrode and a support member which extends vertically on one surface of the gate electrode.

According to the present invention, there is also provided a gate electrode structure manufacturing method comprising the steps of forming a plate-like body having a gate electrode, and forming a support member which extends vertically on one surface of the plate-like body.

DESCRIPTION OF THE PREFERRED EMBODIMENT

An embodiment of the present invention will be described in detail with reference to the accompanying drawings.

Figure 1:
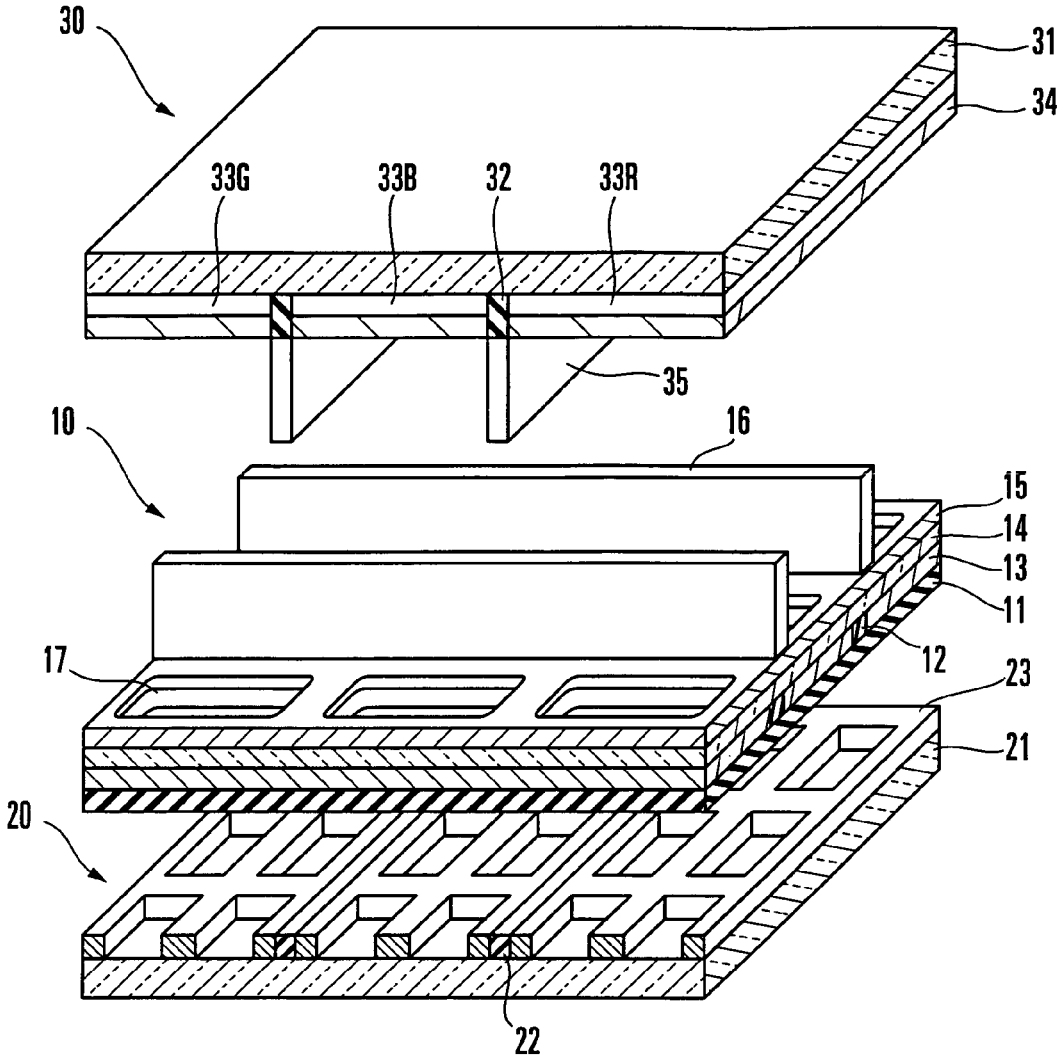
FIG. 1 is a partially exploded sectional view showing the arrangement of a flat panel display according to an embodiment of the present invention.
Figure 2:
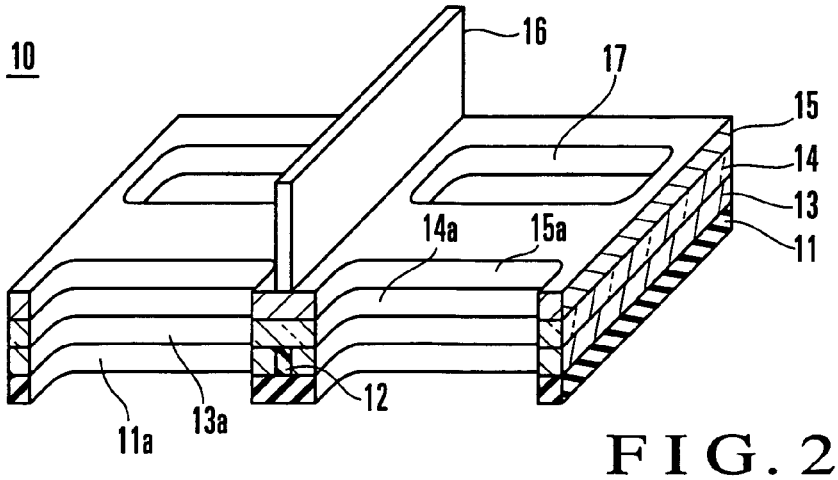
FIG. 2 is a perspective sectional view showing the arrangement of a gate substrate in FIG. 1.

As shown in FIG. 1, a flat panel display 1 according to this embodiment has a cathode substrate 20 having a substrate 21 made of glass or the like, an anode substrate 30 having an at least partially transparent front glass 31, and a gate substrate (gate electrode structure) 10 which is disposed to be substantially parallel to the substrate 21 and front glass 31. The substrate 21 of the cathode substrate 20 and the front glass 31 of the anode substrate 30 are arranged to oppose each other through a frame-like spacer glass and are adhered to the spacer glass with low-melting frit glass to form an envelope. The interior of the envelope is maintained at a vacuum degree on the order of $10^{-5}$ Pa.

The cathode substrate 20 has the substrate 21 described above, a plurality of substrate ribs 22, and cathodes 23. The substrate ribs 22 vertically extend on that surface of the substrate 21 which opposes the gate substrate 10 at a predetermined interval to be parallel to each other. The cathodes 23 are disposed on those regions of the substrate 21 which are sandwiched by the substrate ribs 22 to substantially form matrices when seen from the top. As the cathodes 23, those obtained by fixing electron-emitting sources made of nanotube fibers such as carbon nanotubes or carbon nanofibers to the surfaces of metal members such as 42-6 alloy members can be used. The upper surfaces of the cathodes 23 have the same heights as those of the upper surfaces of the substrate ribs 22.

The anode substrate 30 has the front glass 31 described above, a plurality of black matrices 32 having rectangular sections, red-, green-, and blue-emitting phosphor films 33R, 33G, and 33B, metal-backed films 34 serving as anodes, and a plurality of front ribs 35 having rectangular sections. The black matrices 32 are formed on that surface of the front glass 31 which opposes the gate substrate 10 to form stripes at a predetermined interval in a direction parallel to the substrate ribs 22 of the cathode substrate 20. The phosphor films 33R, 33G, and 33B are formed on those regions of the front glass 31 which are sandwiched by the black matrices 32. The metal-backed films 34 are formed on those regions of the front glass 31 which are sandwiched by the phosphor films 33R, 33G, and 33B. The front ribs 35 vertically extend on the black matrices 32 at a predetermined interval toward the gate substrate 10.

The front ribs 35 form rods or plates which are very thin as compared to their lengths. The front ribs 35 are made of a material having a small secondary electron emission ratio in consideration of secondary electron emission from the front ribs 35, or a slightly conductive material so the front ribs 35 will not accumulate electrons. For example, a glass paste containing chromium oxide or the like, more specifically, one of NP-7800 series (manufactured by Noritake Kizai K.K.) such as NP-7833, can be used.

The gate substrate 10 is sandwiched in the envelope by the substrate ribs 22 of the cathode substrate 20 and the front ribs 35 of the anode substrate 30. The gate substrate 10 has a second insulating layer 11 which is arranged to oppose the cathode substrate 20, a plurality of parallel ribs 12 which are formed on the anode substrate 30-side surface of the second insulating layer 11 to be spaced apart from each other at a predetermined interval, gate electrodes 13 which are disposed between the ribs 12, a first insulating layer 14 which is formed on the ribs 12 and gate electrodes 13, a flat electrode 15 which is disposed on the first insulating layer 14 to serve as a field control electrode, and a plurality of gate ribs 16 which extend vertically on the flat electrode 15 at a predetermined interval toward the front glass 31, run in a direction perpendicular to the front ribs 35, and each have a rectangular section. The gate substrate 10 has electron-passing holes 17 which are formed at regions where the gate electrodes 13 and cathodes 23 intersect, and extend through the second insulating layer 11, gate electrodes 13, first insulating layer 14, and flat electrode 15. The gate substrate 10 excluding the gate ribs 16 will be referred to as a "plate-like body".

The second insulating layer 11 is made of, e.g., frit glass or PPSQ (PolyPhenyl SilsesQuioxane), and has a plurality of openings 11*a* (see FIGS. 7A and 7B to be described later) which are spaced apart from each other at predetermined intervals in the widthwise and longitudinal directions of the front ribs 35. The openings 11*a*, together with the openings of the gate electrodes 13, first insulating layer 14, and flat electrode 15 to be described later, form part of the electron-passing holes 17.

The ribs 12 are made of a vitreous insulating paste into rods or plates each having a rectangular section. The ribs 12 are formed on the second insulating layer 11 at the intermediate portions of the openings 11*a* that are adjacent in either the widthwise or longitudinal direction. Hence, the ribs 12 line up to be spaced apart from the adjacent ones at predetermined intervals. Such ribs 12 serve as a guide to dispose the gate electrodes 13 to be spaced apart from each other at predetermined intervals.

The gate electrodes 13 are formed of strip-like flat plates, e.g., flat plates made of a conductor such as a 42-6 alloy. The gate electrodes 13 have openings 13*a* (see FIGS. 6A and 6B to be described later) at a predetermined interval in the longitudinal direction to form part of the electron-passing holes 17.

The first insulating layer 14 is made of, e.g., frit glass. The first insulating layer 14 has openings 14*a* (see FIGS. 4A and 4B to be described hereinafter), which are substantially rectangular when seen from the top, at the equal interval to that of the openings 11*a* of the second insulating layer 11. The openings 14*a* form part of the electron-passing holes 17.

The flat electrode 15 is formed of flat plates made of a conductor such as a 42-6 alloy. The flat electrode 15 has openings 15*a*, which are substantially rectangular when seen from the top, at the equal interval to that of the openings 11*a* of the second insulating layer 11 and that of the openings 14*a* of the first insulating layer 14. The openings 15*a* form part of the electron-passing holes 17. The flat electrode 15 not only accelerates electrons extracted from the electron-emitting sources of the cathodes 23 but also shields the electric field of the metal-backed films 34 serving as the anodes to prevent leaking light.

The gate ribs 16 form rods or plates each having a rectangular section. The gate ribs 16 are formed on the flat electrode 15 at the intermediate portions of the electron-passing holes 17 that are adjacent in either the widthwise or longitudinal direction. For example, the gate ribs 16 are formed immediately on the ribs 12. Hence, the gate ribs 16 line up to be spaced apart from the adjacent ones at predetermined intervals. In the case of FIG. 1, the gate ribs 16 are formed in a direction perpendicular to the front ribs 35. Such gate ribs 16 are made of a material having a small secondary emission ratio in consideration of secondary emission from the gate ribs 16, or a slightly conductive material so the gate ribs 16 will not accumulate electrons. For example, a glass paste containing chromium oxide or the like, more specifically, one of NP-7800 series (manufactured by Noritake Kizai K.K.) such as NP-7833, can be used.

Figure 3A:
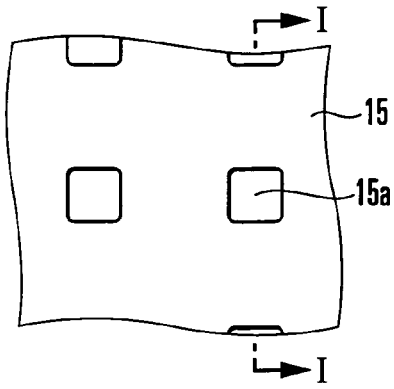
FIGS. 3A, 4A, 5A, 6A, 7A, and 8A are partial plan views showing the steps in manufacturing the gate substrate of FIG. 1, and FIGS. 3B, 4B, 5B, 6B, 7B, and 8B are sectional views taken along the lines I-I of FIGS. 3A, 4A, 5A, 6A, 7A, and 8A, respectively.
Figure 3B:
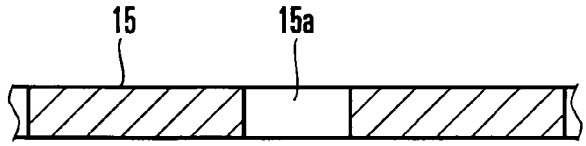

A method of forming the gate substrate 10 will be described with reference to FIGS. 3A and 3B to FIGS. 8A and 8B. First, the flat electrode 15 is prepared as shown in FIGS. 3A and 3B. The plurality of openings 15*a* which are substantially rectangular when seen from the top are formed in the flat electrode 15 in advance with a known etching method such as wet etching, dry etching, or electric field etching, such that they are spaced apart from each other by predetermined intervals.

Figure 4A:
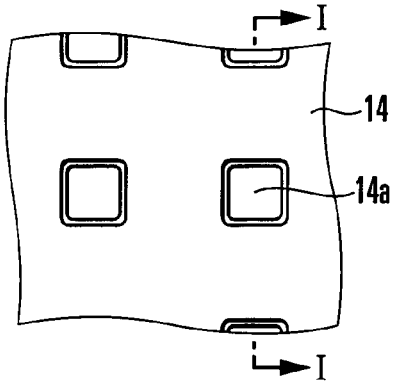
Figure 4B:
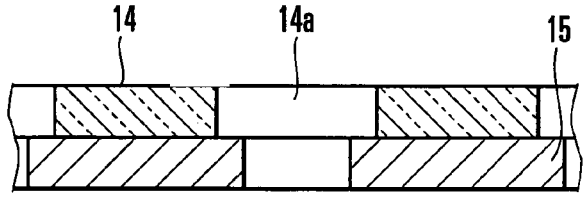

Using a predetermined mask pattern, frit glass is printed and calcined on the flat electrode 15 with a known printing method such as screen printing. As shown in FIGS. 4A and 4B, this forms the first insulating layer 14 having the openings 14*a*, which form the electron-passing holes 17, at positions corresponding to the openings 15*a* of the flat electrode 15.

Figure 5A:
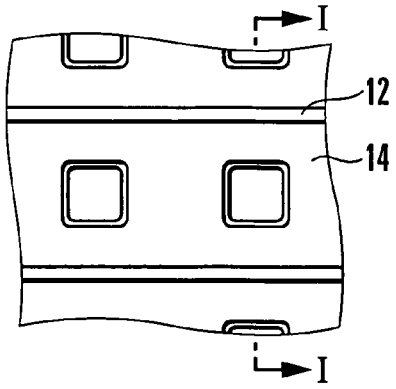
Figure 5B:
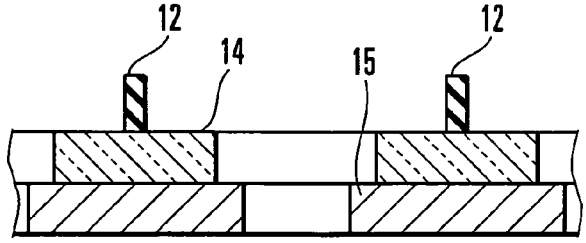

Subsequently, using a predetermined mask pattern, a vitreous insulating paste is printed on the first insulating layer 14 with a known printing method such as screen printing. This forms the ribs 12 on the first insulating layer 14, as shown in FIGS. 5A and 5B. With the ribs 12, the gate electrodes 13 can be positioned accurately.

Figure 6A:
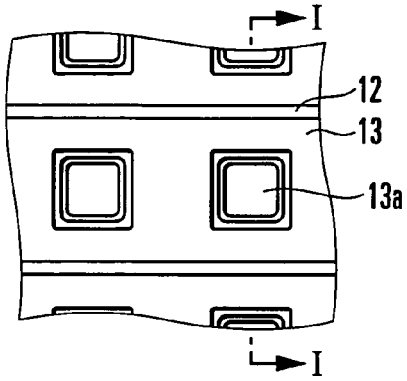
Figure 6B:
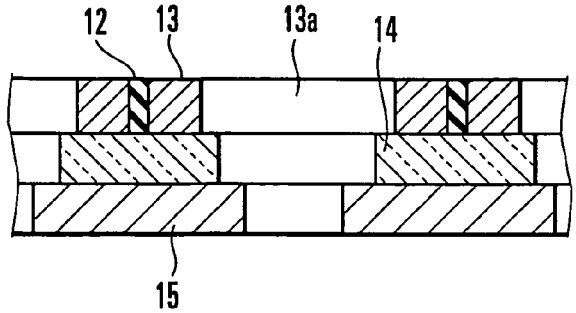

As shown in FIGS. 6A and 6B, the gate electrodes 13, in which the openings 13*a* are formed in advance with a known etching method such as wet etching, dry etching, or electric field etching, are disposed at those regions on the first insulating layer 14 which are sandwiched by the ribs 12. The surfaces of the gate electrodes 13 on the first insulating layer 14 side are entirely fixed to the first insulating layer 14 by adhesion with frit glass or the like such that the openings 13*a* overlap the openings 14*a* of the first insulating layer 14.

Figure 7A:
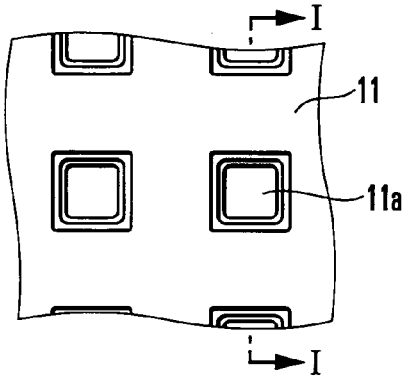
Figure 7B:
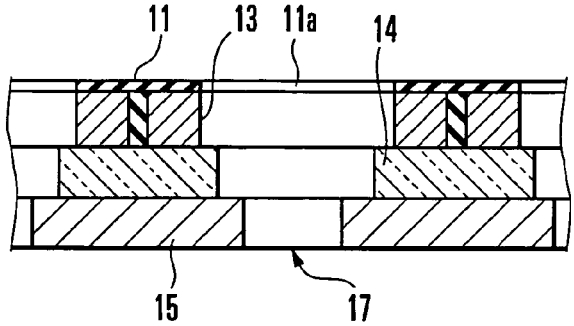

Using a predetermined mask pattern, frit glass is printed and calcined on the ribs 12 and gate electrodes 13 with a known printing method such as screen printing. As shown in FIGS. 7A and 7B, this forms the second insulating layer 11 having the openings 11*a*, which form the electron-passing holes 17, at positions corresponding to the openings 15*a* of the gate electrodes 13.

Figure 8A:
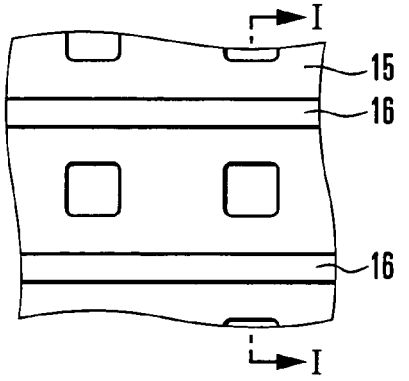
Figure 8B:
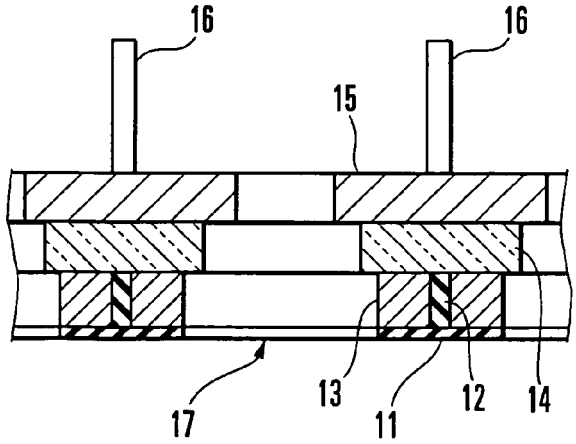

Subsequently, using a predetermined mask pattern, frit glass is repeatedly printed and calcined on that surface of the flat electrode 15 which is opposite to the surface where the first insulating layer 14 has been formed, with a known printing method such as screen printing. As shown in FIGS. 8A and 8B, this forms the gate ribs 16 on the flat electrode 15.

Alternatively, the gate ribs 16 can be formed in the following manner. First, a vitreous paste mixed with a resin that is cured by ultraviolet radiation is prepared. This paste is discharged from a tapered nozzle onto that surface of the flat electrode 15 which is opposite to the surface where the first insulating layer 14 has been formed. The paste is irradiated with ultraviolet rays so its surface is cured. In this state, the paste is calcined so it is cured to its interior. Hence, for example, the gate ribs 16 having widths of 50 μm to 200 μm and heights of 1 mm to 2 mm can be formed. The gate ribs 16 having the above heights can be formed by conducting only once the series of steps of discharging the paste, ultraviolet radiation, and calcination. Alternatively, the series of steps may be performed a plurality of number of times to form the gate ribs 16 to desired heights.

In the above description, after the ribs 12 are formed, the gate electrodes 13 are disposed on the first insulating layer 14. Alternatively, the gate electrodes 13 may be disposed on the first insulating layer 14 after the gate ribs 16 are formed. This case will be described hereinafter.

First, as shown in FIGS. 5A and 5B, the ribs 12 are formed on the first insulating layer 14, and thereafter the gate ribs 16 are formed on the flat electrode 15. The second insulating layer 11 is formed on one surface of the gate electrodes 13. The ribs 12 are formed to have substantially the same thicknesses as those of the gate electrodes 13.

Then, the gate electrodes 13 on which the second insulating layer 11 is formed are fitted on those regions of the first insulating layer 14 which are sandwiched by the ribs 12, from the surface where the second insulating layer 11 is not formed. At this time, the gate electrodes 13 may be positioned by adhering one end in the longitudinal direction of each gate electrode 13 on the first insulating layer 14 with frit glass or the like.

The gate substrate 10 can be formed in this manner as well. In this case, the second insulating layer 11 is not formed on the ribs 12. The second insulating layer 11 need not be formed on the ribs 12 as far as the gate electrodes 13 are not in direct contact with the cathodes 23.

The method of forming the gate substrate 10 has been described so far. The cathode substrate 20 and anode substrate 30 can be formed in the same manner as in the conventional case. The substrate ribs 22 of the cathode substrate 20 and the front ribs 35 of the anode substrate 30 can be formed by employing the method including ultraviolet radiation and calcination of the paste which has been described regarding the gate ribs 16.

The positional relationship between the gate substrate 10 and anode substrate 30 (both are described above) in the flat panel display according to this embodiment will be described with reference to FIG. 9. According to this embodiment, the front ribs 35 are formed on the front glass 31 of the anode substrate 30, and the gate ribs 16 are formed on the flat electrode 15 of the gate substrate 10. The gate ribs 16 are in contact with the front ribs 35 to support the anode substrate 30. Namely, the gate ribs 16 serve as a support member. In this manner, in the flat panel display of this embodiment, not only the front ribs 35 but also the gate ribs 16 are provided between the anode substrate 30 and gate substrate 10. Thus, the distance between the gate substrate 10 and anode substrate 30 can be increased to be larger than in a case wherein only the front ribs 135 are provided as in the conventional flat panel display.

Conventionally, the gate ribs cannot be formed on the gate substrate 110. This is because of the following reason. The glass plate 111 having a thickness of about 0.1 mm is used as the insulating layer that separates the gate electrodes 113 from the flat electrode 112. If the gate electrodes 113 and flat electrode 112 are respectively printed on the two surfaces of the glass plate 111 and the gate ribs are formed on the flat electrode 112 by repeating printing, the glass plate 111 may be broken. In view of this, according to this embodiment, the flat electrode 15 is formed of a conductive plate. Then, even if the gate ribs 16 are printed on the flat electrode 15 by repeating printing, the first insulating layer 14 will not be broken, so the gate ribs 16 can be formed on the gate substrate 10.

In this manner, according to this embodiment, the gate ribs 16 can be formed on the gate substrate 10. Thus, the distance between the gate substrate 10 and anode substrate 30 can be increased to such a degree that even when a high voltage is applied to the metal-backed films 34, abnormal discharge will not occur between the cathodes 23 and metal-backed films 34.

Figure 9:
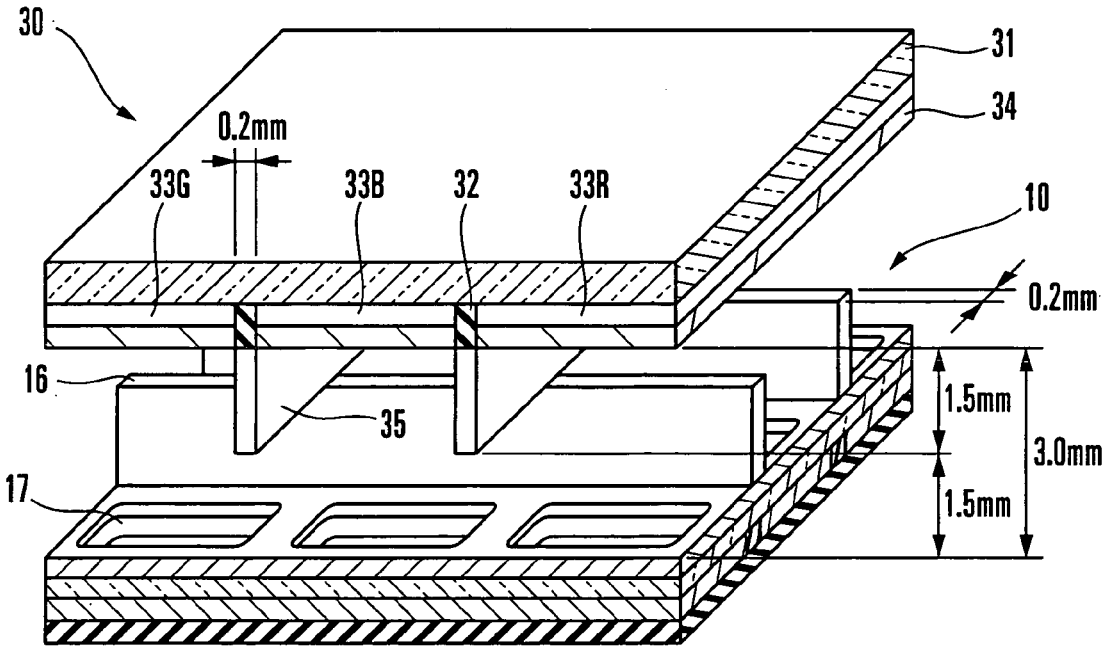
FIG. 9 is a main part sectional view showing the arrangement of the flat panel display according to the embodiment shown in FIG. 1 of the present invention.

Therefore, as shown in, e.g., FIG. 9, if the gate ribs 16 and front ribs 35 are formed to have heights of 1.5 mm, the distance between the gate substrate 10 and anode substrate 30 becomes 3.0 mm. A high voltage of about 10 kV can be applied to the metal-backed films 34, so that a high luminance can be realized. At this time, while the gate ribs 16 and front ribs 35 are formed to have widths of, e.g., 0.2 mm in FIG. 9, they can be formed to have widths of about 0.05 mm to 0.2 mm. As a result, micropatterning can also be realized simultaneously.

Modifications of the gate substrate 10 will be described. The direction in which the gate ribs 16 are to be formed is not limited to the direction perpendicular to the front ribs 35, as shown in FIG. 1, but may be a direction merely intersecting the front ribs 35. The gate ribs 16 may be formed in a direction parallel to the front ribs 35, like gate ribs 16*a* of a gate substrate 10*a* shown in FIG. 10. In this case, regarding the gate ribs 16*a* and front ribs 35, the gate ribs 16*a* and front ribs 35 at opposing positions are in contact with each other.

Figure 10:
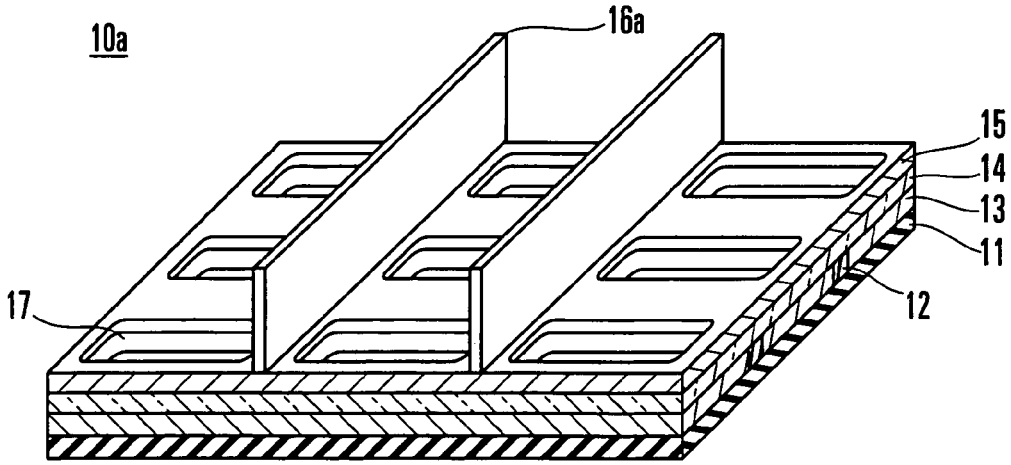
FIGS. 10, 11, 12A, and 12B are perspective sectional views showing modifications of the gate substrate.
Figure 11:
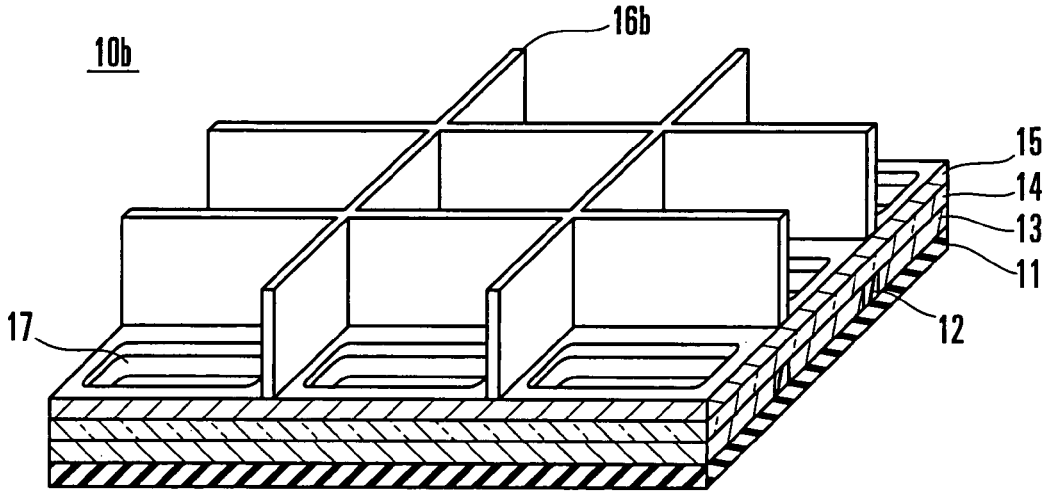

The gate ribs are not limited to the rods as shown in FIGS. 1 and 10, but may substantially form matrices when seen from the top, which extend vertically on the flat electrode 15, like gate ribs 16*b* of a gate substrate 10*b* shown in FIG. 11. In this case, the gate ribs 16*b* are formed by repeatedly printing and calcining frit glass on the flat electrode 15 to a predetermined height using a predetermined mask pattern, with a known printing method such as screen printing. With the matrix shape, the gate ribs 16*b* can improve the resistance against the pressures from the cathode substrate 20 and anode substrate 30 which result from the atmospheric pressure or the like.

Figure 12A:
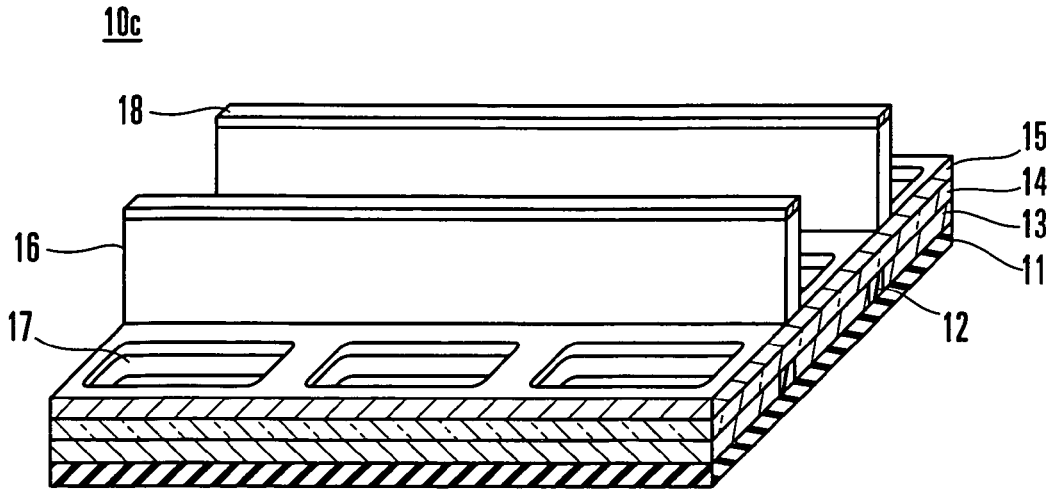

As in a gate substrate 10*c* shown in FIG. 12A, focus electrodes 18 may be formed on the distal end faces of the gate ribs 16 which oppose the front ribs 35. A positive potential equal to that applied to the flat electrode 15 is applied to the focus electrodes 18. It was confirmed that with the focus electrodes 18, electrons extracted from the cathodes 23 and emitted from the electron-passing holes 17 converge toward the centers of the phosphor films 33R, 33G, and 33B from the side surfaces of the front ribs 35. This may be because the strength of the electric field generated by the metal-backed films 34 which serve as the anodes is changed by the electric field generated by the focus electrodes 18.

The focus electrodes 18 can shield the cathodes 23 and gate electrodes 13 from the influence of the electric field generated by the metal-backed films 34, so an electric field will not be generated by the potential difference between the gate electrodes 13 and the metal-backed films 34 which serve as the anodes. Thus, abnormal discharge between the cathodes 23 and metal-backed films 34, and leaking light can be prevented.

Figure 12B:
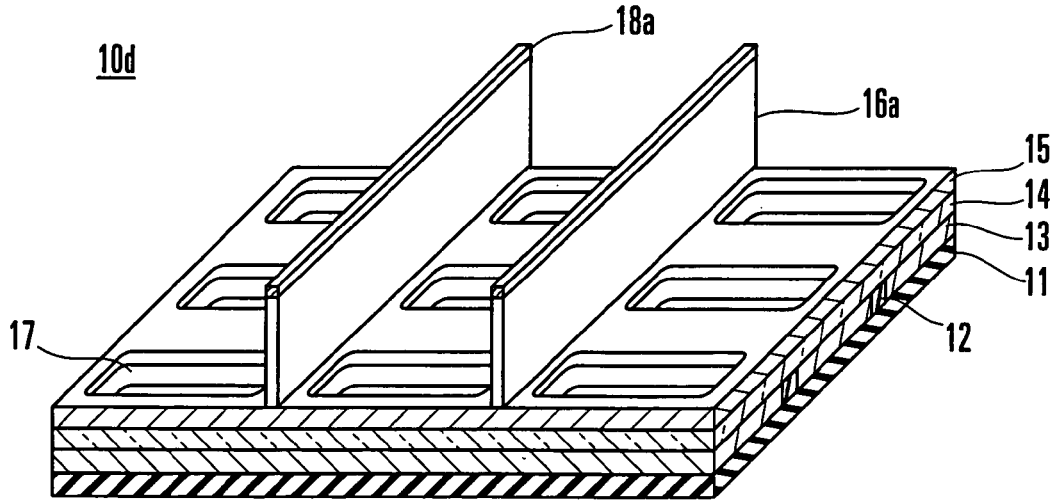

The focus electrodes 18 can be formed by printing, e.g., silver paste on the gate ribs 16 with a known printing method such as screen printing. The positions to form the focus electrodes 18 are not limited to on the gate ribs 16 shown in FIG. 12A which are perpendicular to the front ribs 35. As in a gate substrate 10*d* shown in FIG. 12B, focus electrodes 18*a* can be formed on gate ribs 16*a* which are parallel to the front ribs 35. Alternatively, the focus electrodes may be formed on gate ribs 16*b* shown in FIG. 11 which substantially form matrices when seen from the top. The focus electrodes may also be formed on those surfaces of the front ribs 35 which oppose the gate ribs 16, 16*a*, or 16*b*.

Figure 13:
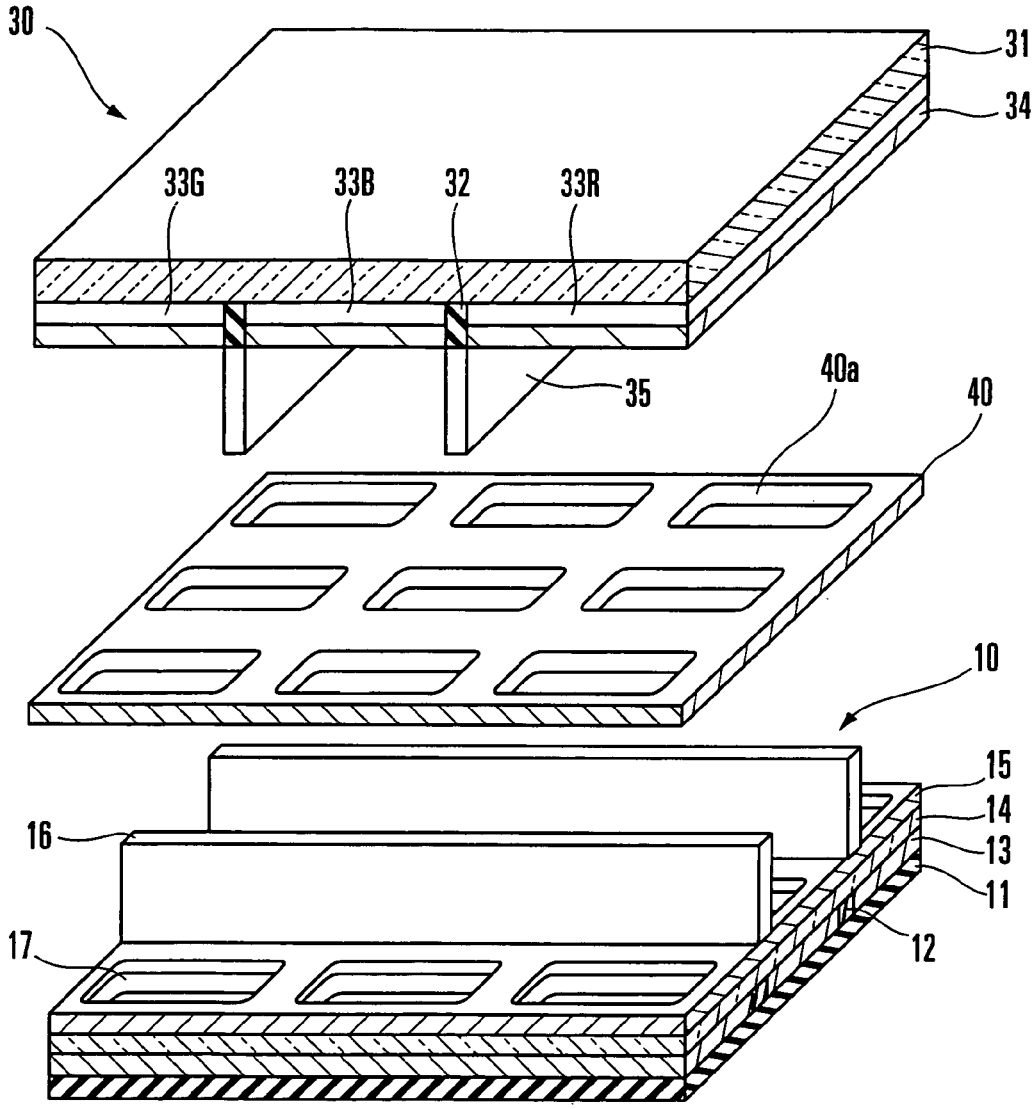
FIGS. 13 and 14 are partially exploded sectional views each showing an arrangement of a flat panel display provided with a focus substrate.
Figure 14:
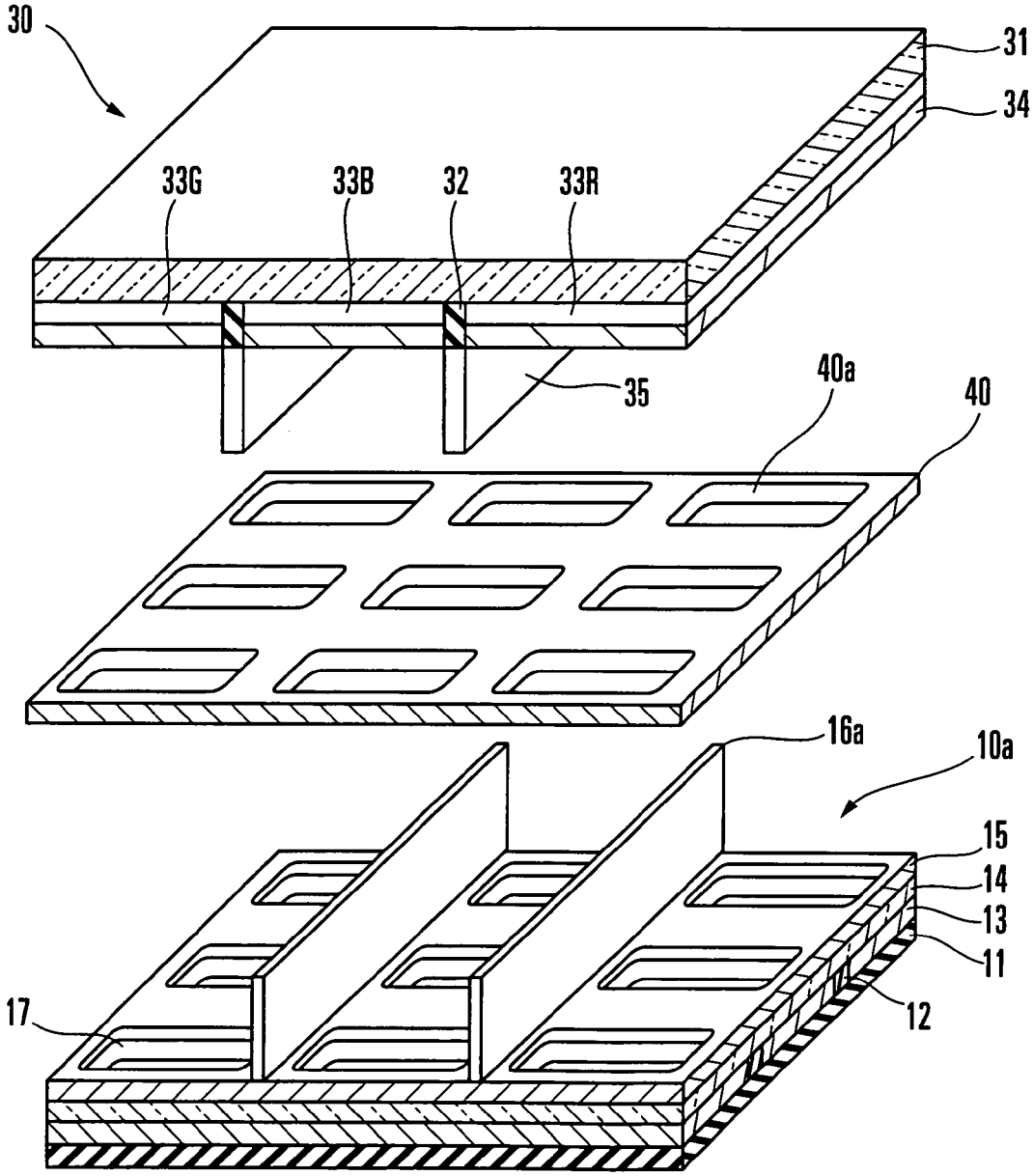
Figure 15:
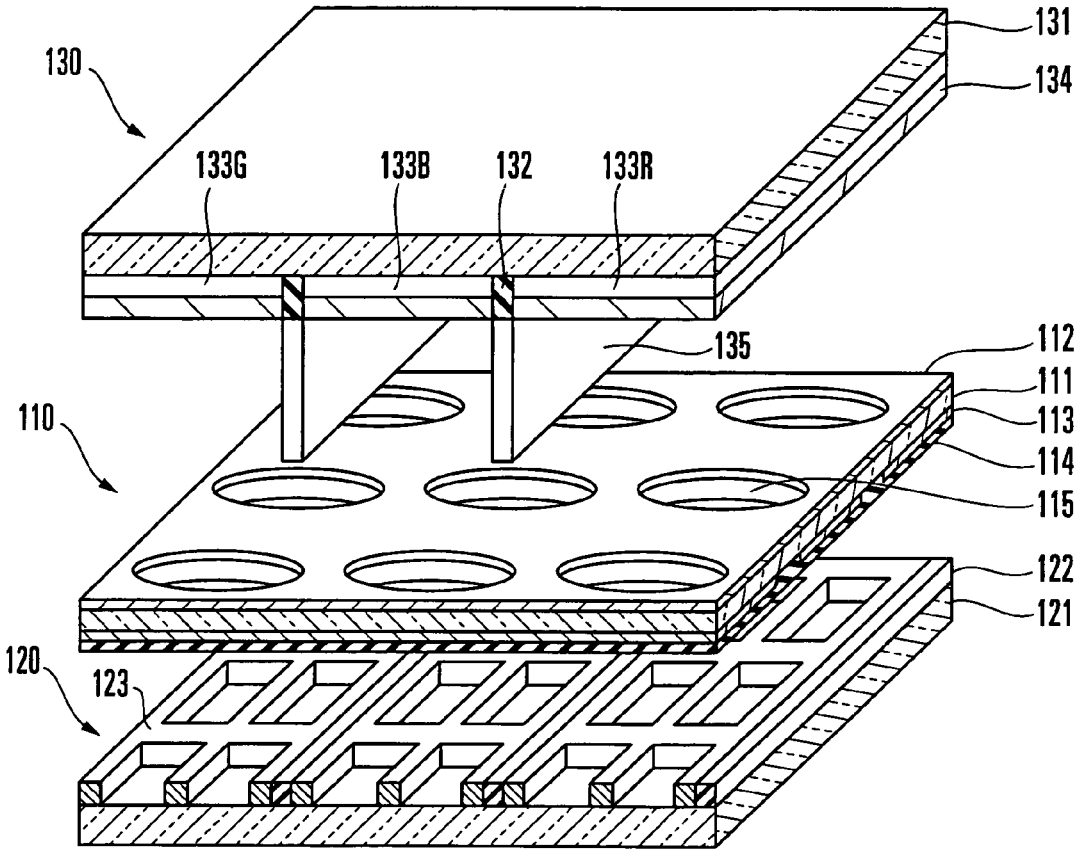
FIG. 15 is a partially exploded view showing an arrangement of a conventional flat panel display.

In place of the focus electrodes 18 described above, as shown in FIG. 13, a focus substrate (focus electrode) 40 may be arranged between the gate ribs 16 and front ribs 35 to be sandwiched by them. The focus substrate 40 is formed of a conductive plate made of, e.g., a 42-6 alloy, and openings 40*a* are formed in it, at positions corresponding to the electron-passing holes 17 of the gate substrate 10, with a known etching method such as wet etching, dry etching, or field etching. With the focus substrate 40, in the same manner as in the case provided with the focus electrodes 18, the gate electrodes 13 can be electrically shielded so as to prevent an electric field from being generated by the potential difference between the gate electrodes 13 and the metal-backed films 34 which serve as anodes. Consequently, abnormal discharge between the cathodes 23 and metal-backed films 34, and leaking light can be prevented. The focus substrate 40 can be formed not only when the gate ribs 16 of the gate substrate 10 are perpendicular to the front ribs 35, as shown in FIG. 13, but also when the gate ribs 16 of the gate substrate 10 are parallel to the front ribs 35, as shown in FIG. 14.

According to this embodiment, the electron-passing holes 17 form substantially matrices when seen from the top. The shapes of the electron-passing holes 17 are not limited to this, but can be set arbitrarily and freely, e.g., substantially circular when seen from the top.

According to this embodiment, one end in the longitudinal direction of each gate electrode 13 is adhered on the first insulating layer 14 with frit glass. Alternatively, an adhesion layer made of frit glass or the like may be formed on the first insulating layer 14, and the gate electrodes 13 may be disposed on the adhesion layer. In this case, the ribs 12 are formed on the adhesion layer as well.

As has been described above, according to the present invention, the gate ribs 16, 16*a*, or 16*b* are formed on one surface of the gate substrate 10, 10*a*, 10*b*, 10*c*, or 10*d*. Thus, the distance between the gate substrate 10, 10*a*, 10*b*, 10*c*, or 10*d* and the metal-backed films 34 serving as the anodes can be increased. Even when a high voltage is applied to the anodes, the cathodes 23 and gate electrodes 13 can be protected from the influence of the electric field generated by the anodes. Thus, discharge between the cathodes 23 and the anodes can be prevented. As a result, a high luminance can be realized.

What is claimed is:

1. A flat panel display comprising:

a substrate;

a front glass which is arranged to oppose said substrate and forms a vacuum envelope together with said substrate, said front glass being transparent at least partially;

a cathode which is arranged on said substrate;

a gate electrode which is arranged between said substrate and front glass, said gate electrode comprising an electron-passing hole through which an electron emitted from said cathode passes;

a plurality of front ribs which extend vertically from said front glass toward said gate electrode, said plurality of front ribs extending vertically at a predetermined interval;

a phosphor film and an anode which are stacked on a region of said front glass which is sandwiched by said front ribs; and a support member made of an electrically conductive glass paste, wherein the support member extends vertically from said gate electrode toward said front glass and is in contact with said front ribs.

2. A display according to claim 1, further comprising:

an first insulating layer which is formed on said gate electrode; and a flat electrode which is formed on said insulating layer, said flat electrode comprising a conductive plate and being arranged to oppose said anode, wherein said support member is formed on an anode side of said flat electrode.

3. A display according to claim 1, wherein said support member comprises a plurality of gate ribs which line up at a predetermined interval.

4. A display according to claim 3, wherein said gate ribs are disposed each at one of a position to be parallel to said front ribs and a position to intersect said front ribs.

5. A display according to claim 1, wherein said support member substantially forms a matrix when seen from a front glass side.

6. A display according to claim 2, further comprising a focus electrode formed on a surface of said support member which opposes said front ribs.

7. A display according to claim 2, further comprising a focus electrode which is sandwiched by said support member and front ribs.

8. A gate electrode structure comprising:

a gate electrode; and a support member made of an electrically conductive glass paste, wherein the support member extends vertically on one surface of said gate electrode.

9. A structure according to claim 8, further comprising:

an insulating layer which is formed on said gate electrode;

a flat electrode which is formed on said insulating layer and comprises a conductive plate; and an electron-passing hole which extends through said gate electrode, insulating layer, and flat electrode, wherein said support member is formed on said flat electrode.

10. A structure according to claim 8, wherein said support member comprises a plurality of gate ribs which line up at a predetermined interval.

11. A structure according to claim 8, wherein said support member substantially forms a matrix when seen from the top.

12. A structure according to claim 9, further comprising a focus electrode which is formed on a distal end face of said support member.

* * * * *